United States Patent [19]

Thiel et al.

[11] 4,164,607

[45] Aug. 14, 1979

[54] THIN FILM RESISTOR HAVING A THIN LAYER OF RESISTIVE METAL OF A NICKEL, CHROMIUM, GOLD ALLOY

[75] Inventors: Ronald A. Thiel; Edward H. Maurer, both of San Diego, Calif.

[73] Assignee: General Dynamics Corporation Electronics Division, San Diego, Calif.

[21] Appl. No.: 784,052

[22] Filed: Apr. 4, 1977

[51] Int. Cl.[2] ..... H01C 7/00; H01C 7/02; H01C 7/04

[52] U.S. Cl. ..... 428/621; 75/165; 75/171; 338/308; 338/309; 427/101; 427/102; 427/103; 427/124; 428/209; 428/210; 428/434; 428/472; 428/672; 428/680; 428/469; 428/630; 428/632; 428/656; 428/667

[58] Field of Search ..... 427/101, 102, 103, 124; 338/308, 309; 428/209, 210, 434, 427, 457, 621, 672, 680, 469, 630, 632; 75/165, 171

[56] References Cited

U.S. PATENT DOCUMENTS

| | | | |
|---|---|---|---|
| 3,296,574 | 1/1967 | Tassara | 338/309 |
| 3,578,420 | 5/1971 | Nishimura et al. | 427/103 |
| 3,833,410 | 9/1974 | Ang et al. | 427/101 |
| 3,904,461 | 9/1975 | Estep et al. | 427/103 |
| 4,019,168 | 4/1977 | Collins | 427/103 |
| 4,021,277 | 5/1977 | Shirn et al. | 427/102 |

FOREIGN PATENT DOCUMENTS

| | | | |
|---|---|---|---|
| 2029265 | 1/1973 | Fed. Rep. of Germany | 427/101 |
| 45-14920 | 5/1970 | Japan | 427/101 |

*Primary Examiner*—John D. Smith
*Attorney, Agent, or Firm*—Brown & Martin

[57] ABSTRACT

High stability thin film resistors are made from an alloy comprising selected portions of nickel, chromium, and gold selected in a ratio to provide the desired temperature coefficient of resistance (TCR). The resistors are made by co-depositing gold with the nickel chromium alloy by a flash evaporation process. The evaporation process is carried out by feeding a nickel chromium wire, having a gold wire extending therealong to provide the desired composition, onto a heated tungsten strip within a vacuum system with substrates disposed in a position to obtain uniform deposition of the evaporated material thereon.

15 Claims, 7 Drawing Figures

THIN FILM RESISTOR HAVING A THIN LAYER OF RESISTIVE METAL OF A NICKEL, CHROMIUM, GOLD ALLOY

BACKGROUND OF THE INVENTION

The present invention relates generally to thin film resistors and pertains particularly to controlled temperature coefficient of resistance thin film resistors and method of making same.

Thin film technology is utilized in the production of micro circuits. The materials produced by the thin film technology frequently have properties different from the same materials in bulk compositions. Accordingly it has been found that bulk or thick film technology cannot be readily adapted to thin film technology.

In the past, thin film resistors have been made from a number of compositions. The primary technique of thin film resistor construction utilizes tantalum, refractory metal oxides, and nickel chromium alloys. Perhaps the most commonly used material at present is that of an alloy of nickel-chromium.

Resistors made of this composition typically have a temperature coefficient of resistance (TCR) which generally runs around 40 to 200 ppm/degree centigrade. While thin film resistors of these materials are satisfactory for many applications, they are unsatisfactory for certain specific advanced applications. The TCR is especially critical in certain micro circuits which are necessarily subjected to extreme environmental conditions. Because of the environmental conditions encountered it is desirable to be able to tailor the circuit to the conditions expected. For example, extreme temperatures can affect the performance of the circuit. It is desirable that the circuit be balanced for the respective temperatures encountered.

It is therefore desirable that thin film resistors and method of making such resistors be available for tailoring the TCR to meet certain requirements.

SUMMARY AND OBJECTS OF THE INVENTION

It is therefore the primary object of the present invention to provide a thin film resistor and method of making which overcomes the above problems of the prior art.

Another object of the invention is to provide a thin film resistor of the above character which is relatively stable through a high range of temperatures.

Another object of the invention is to provide a thin film resistor of the above character which can be manufactured with substantially conventional techniques.

Another object of this invention is to provide a thin film resistor and method of making which can predictably be made to have any TCR between at least −65 to +65 ppm/°C.

Another object of the invention is to provide thin film resistors which are particularly adapted for use in integrated circuitry.

Another object of the invention is to provide a thin film resistor which makes it possible to obtain substantially zero TCR.

Another object of the invention is to provide a thin film resistor which can be very thin and still be stable.

Another object of the invention is to provide a thin film resistor having excellent power handling capabilities.

BRIEF DESCRIPTION OF THE DRAWINGS

The above and other objects and advantages of the present invention will become apparent from the following description when read in conjunction with the accompanying drawings, wherein.

DETAILED DESCRIPTION OF PREFERRED EMBODIMENTS

Figure 1:
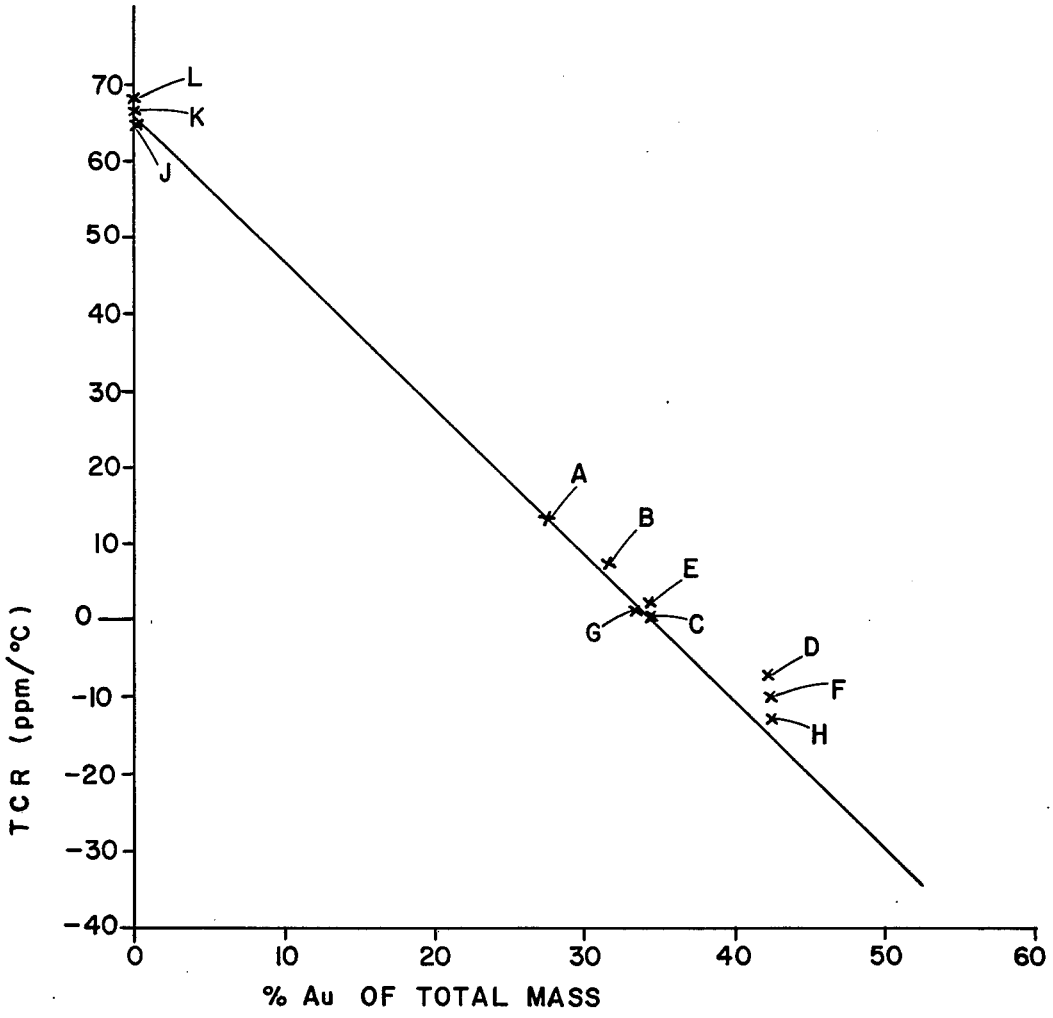
FIG. 1 is a graph showing the relationship of TCR to percentage of gold in the total mass deposited.

Turning to FIG. 1 of the drawing, there is illustrated a graph of the relationship of the temperature coefficient of resistance in parts per million per degree centigrade plotted against the percent of gold in the total mass of the thin film forming the resistor. These plots are of specific deposition runs of thin film resistors made and results obtained during a series of tests. These tests were run in sequence from A through L. Run A, for example, illustrates approximately 28½% of gold in a total mass of 42 milligrams evaporated. The thickness of the film will be directly proportional to the total mass evaporated. The tests on this run indicate a TCR of approximately 12 for this particular sample.

Test or run B illustrates approximately 32% of gold in a total mass of 38 milligrams evaporated. The test of this deposited film shows a TCR of approximately +6 for this particular percentage of the gold in the total composition.

The run or sample C shows approximately 35% of gold of the total mass of 43 milligrams evaporated. A test of this film indicates a zero TCR for this particular percentage relationship between the elements of the film.

The next run or test D shows a percentage of gold of approximately 43% in a total mass of 64 milligrams of the material evaporated. The test of this run or film indicates a TCR of approximately −8 for this particular composition.

The next run at E again utilizes approximately 35% gold of the total mass of 43 milligrams. Again this percentage of the composition gives a TCR of approximately zero.

Another run F, at approximately 43% of gold of a total mass of 49 milligrams gives a TCR of approximately −10 for this run.

The next run in the series at G was again approximately 35% gold of the total mass of approximately 47.3 milligrams. Again this percentage of the total mass gave a TCR of zero parts per million per degree centigrade.

The next test in the series at H comprised approximately 43% gold in a total mass of 47.2 milligrams. A test of this film gave indication of a TCR of approximately 14 on the negative side of the scale.

This group of tests as plotted indicated a fairly consistent relationship between the percentage of gold in the total mass and the TCR in parts per million per degree centrigrade. The line through these points indicates a substantially constant slope to the line.

A further series of runs J, K, L, wherein the percentage of gold in the total mass was zero, gives a TCR of approximately 65 for this series of runs. It is therefore apparent from this test and series of runs that the TCR of a thin film resistor of this specified composition can be selectively adjusted in direct proportion to the percentage of gold to the total mass in the composition. The above tests were carried out under controlled conditions and these results obtained. It also appears that the TCR obtained by this method is independent of the thickness of the film. This is an advantage in that it permits varying the thickness to control the ohms per square without altering the TCR. We have also found that changes in substrate temperature during deposition give a different TCR for a given composition. For example, some tests of films deposited at lower substrate temperatures than those reported above were found to have lower TCRs for the same percentage of gold in the composition.

Some tests other than those depicted on the graph of FIG. 1 yielded TCRs of approximately −40 ppm/°C. It is predicted that a combination of high percent of gold and low substrate temperature will produce the lowest values of TCR. While obviously there is a lower limit of TCR obtainable by this method we predict that −65 ppm/°C. is easily obtainable.

Other factors such as roughness or thermal expansion coefficient of the substrate may also yield a different TCR for the same material deposited in the same way. Accordingly changes in the percentage of gold in the composition may have to be changed to obtain a given TCR with such diverse factors.

Figure 2:
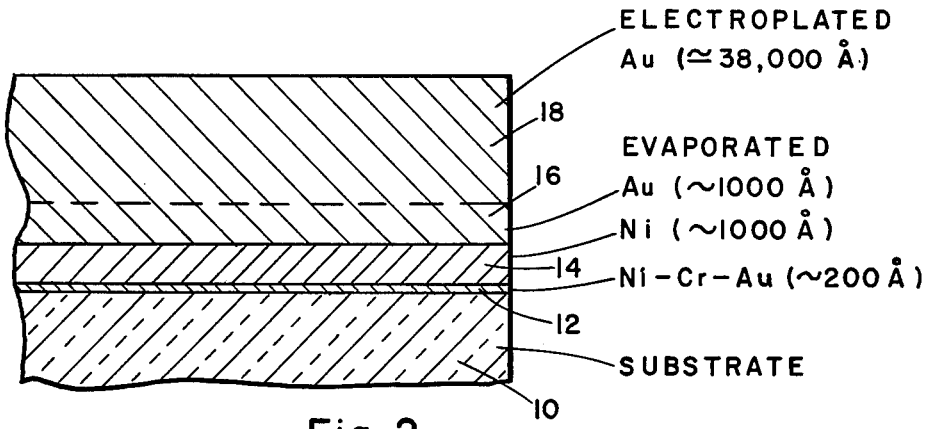
FIG. 2 is a greatly enlarged cross section of a typical resistor.
Figure 3:
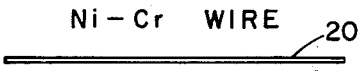
FIGS. 3 through 6 illustrates the steps in preparing a wire charge for the vacuum deposition of the resistor layers.

Turning now to FIG. 2 of the drawing, a cross sectional view greatly enlarged of a typical resistor and thin film layers is illustrated. The illustration is not to scale but is merely for illustrative purposes only.

A suitable dielectric substrate 10 is selected of which the typical is alumina and a thin film 12 of the desired or selected composition is deposited by a flash evaporation process, to be described, onto the substrate. Although flash evaporation is preferred, sputtering could also be used. A layer of nickel 14 is then applied on top of the composition layer 12 by flash evaporation and thereafter a layer of gold 16 is similarly applied. After the layer of evaporated gold is applied a second layer of gold of approximately 38,000 angstroms is applied, such as by electroplating, on top of this layer. The layers of gold are applied for conductors for connecting the resistors into the circuit. After the desired films are laid on the substrate the usual etching processes are carried out to form a desired circuit. Although the specific combination illustrated is nickel and gold, wherein the gold is for good conductivity and wire bonding and the nickel is to provide a diffusion barrier between the resistor film and the gold conductor, other possibilities for conductors are aluminum, copper, and tin, for example. One combination, for example, may utilize aluminum as a conductor material since it is so widely used as a conductor material for silicon integrated circuits. Some high performance integrated circuits for example, use nickel chromium thin film resistors deposited on the oxidized silicon surface and interconnected with the aluminum metal. This would be an area of applicaton of the present process. Other substrates such as glass, sapphire, and beryllium oxide may also be used.

Figure 4:
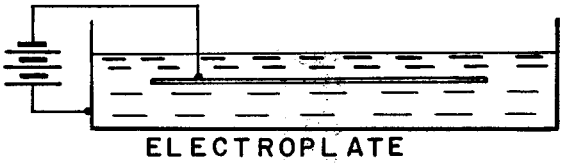

Turning now to FIGS. 3 through 7 the process of the present invention is best illustrated. A first step in a process is that of preparing a charge of wire for the evaporation process. This charge of wire must have the appropriate combination of percentages of the nickel chromium and gold to obtain the desired results. One approach to obtaining this is to select a core wire of nickel chromium and adjusting the composition or percentage thereof to the desired composition if necessary. The usual wire compositions available in nickel chromium contains less than 30% chrome. The maximum percentage of chrome available in nickel chromium wire form is 30% chrome. In order to obtain a higher percentage of chrome, chormium is plated on the wire by electroplating, as shown in FIG. 4, to obtain the desired percentage of chromium in the combination. A typical composition of 40% nickel, 60% chrome would be produced by plating sufficient chrome onto a 0.010 inch 70/30 nickel chromium wire to raise the diameter to 0.0136 inches or equivalently to raise its lineal density to 18.03 milligrams per inch.

Starting with this new core wire of nickel chrome the proper percentage of gold is either applied by electroplating onto the core wire or by overwinding with a small diameter typically 0.002 inches gold wire. Alternately the gold wire may be attached in parallel as a parallel strand of gold wire of appropriate diameter so as to produce a composite wire of a specific percent of weight of gold. For a given nickel chromium ratio the exact TCR of the resulting film is obtained by adjusting the overall percent of gold as shown on the graph of FIG. 1 for a given substrate temperature.

The actual deposition is accomplished by flash evaporation in a vacuum where the wire is fed onto a resistance heated tungsten strip. The tungsten strip is heated by a electrical current to the proper temperature. The flash evaporation process results in a film with the same composition as the wire and the feed rate of the wire determines the deposition rate.

Figure 5:
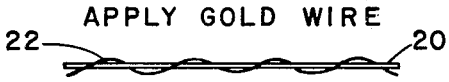
Figure 6:
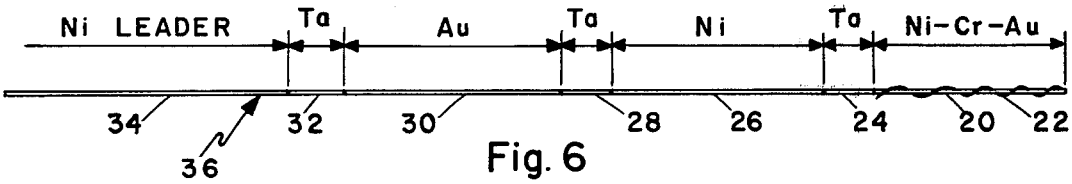

After the percentage ratio composition is determined and a wire prepared such as illustrated in FIG. 5, a wire charge for the total vacuum deposition is prepared as illustrated in FIG. 6. This wire charge comprises a first section made up of the core wire 20 and gold wire 22 but welded at one end to a short lead 24 of tantalum. The mass of the nickel chromium gold wire combination 20, 22 is selected to provide the overall amount of film to be deposited. This is determined by the length and the size or diameter of the combination. The tantalum section 24 provides a stop for the first deposition layer, since it will not evaporate at the temperature used.

A second layer to be deposited comprises a nickel wire 26 of the appropriate diameter and length to obtain the desired amount or layer of nickel on the nickel chromium gold combination layer. This wire is butt welded to the tantalum section 24 and at its opposite end to another tantalum section or stop 28. Thereafter a gold wire 30 is then butt welded to the other end of tantalum stop 28 and additional tantalum stop 32 is attached to the opposite end of the gold lead or wire 30. A leader of nickel 34, for example, is then attached to the end of the tantalum stop 32.

This wire charge designated generally by the numeral 36 is then loaded into a suitable device for feeding onto a heating element for flash evaporation of the wire charge which is then deposited as a thin film in a vacuum chamber upon a selected substrate.

Figure 7:
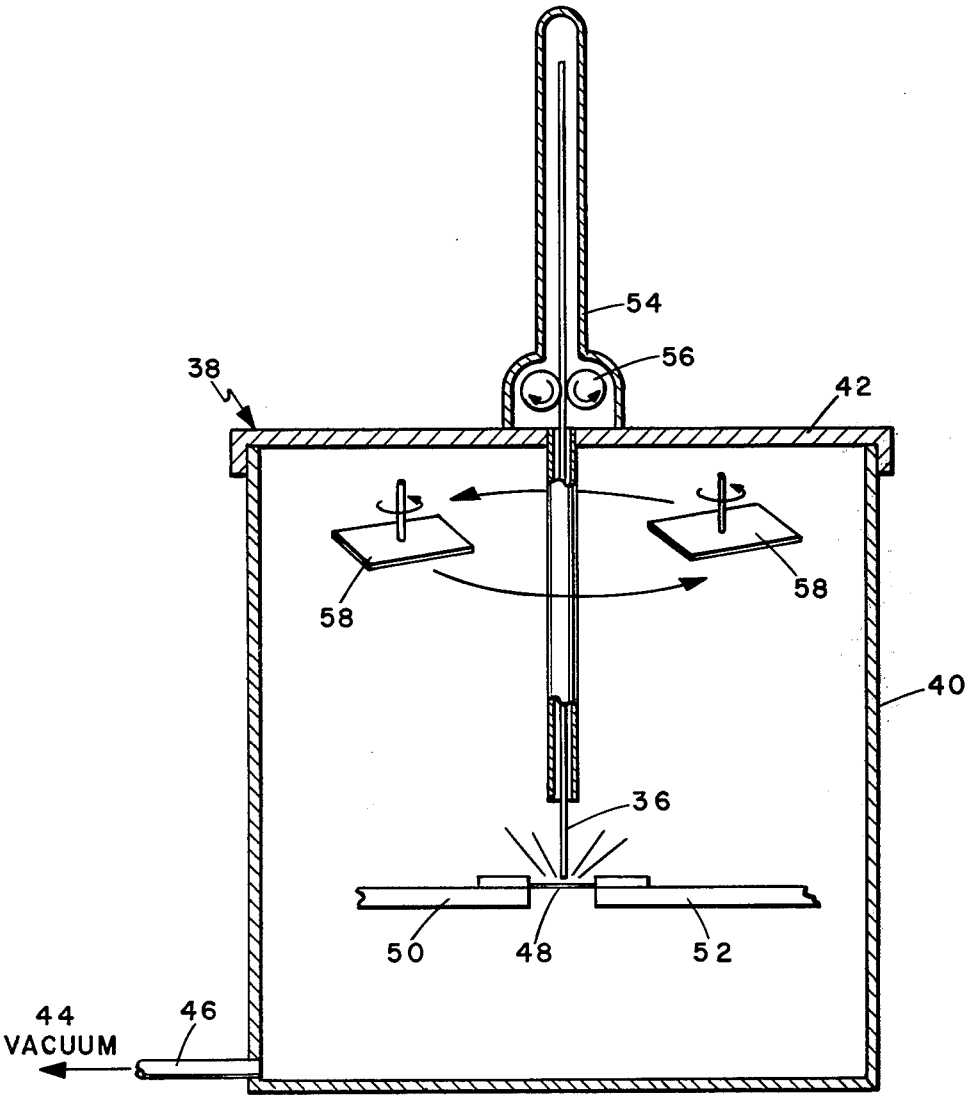
FIG. 7 illustrates diagrammatically the vapor deposition technique.

Turning now to FIG. 7, a device generally designated by the numeral 38 is schematically illustrated for evaporating and depositing the films on a selected substrate. This apparatus generally comprises a vacuum chamber defined by a suitable enclosable vessel 40 having an closure 42 for providing an enclosed chamber having a suitable vacuum means 44 connected to the chamber by suitable conduit means 46 for drawing a vacuum within the chamber. A tungsten strip heating element 48 is mounted between a pair of electrical conductors 50 and 52 within the chamber and a suitable electrical current passed therethrough. The wire charge 36 is mounted within a suitable feeding device 54 including feeding means 56 such as a pair of rollers for feeding the wire onto the tungsten strip 48. A plurality of substrates 58 are mounted on a suitable planetary drive mechanism in the upper portion of the chamber for the combination of orbiting and rotating about the center of the flash evaporation. This constant orbiting and rotation of the substrates in conjunction with the appropriate distance from the source insures a uniform deposition of the metal vapors on the surface thereof. Upon completion of the deposition process the plates or substrates are removed from the chamber and processed in the usual manner for building electrical circuits.

In the preferred embodiment of the depositing device 38, the feeding device 54 is gimbal and bellows mounted so that the charge 36 can be steered or moved relative to the tungsten strip 48. This permits the charge to be steered to the side of the strip when a tantalum stop is encountered so that the stop can be removed by touching the charge to the tungsten strip just above the stop, melting it loose from the next charge to be deposited.

While the present invention has been illustrated and described by means of specific embodiments, it is to be understood that numerous changes and modifications may be made therein without departing from the spirit and scope of the invention as defined in the appended claims.

Having described our invention, we now claim:

1. A thin film resistor comprising:
   - a substrate of insulating material defining a support surface, and
   - a thin layer of resistive metal comprising an alloy consisting of nickel, chromium, and gold of predetermined weight percentages wherein the percentage of gold is not greater than the combined percentage of nickel and chromium.

2. The thin film resistor of claim 1, wherein the percentage of gold in said alloy is less than the percentage of either of the other two metals.

3. The thin film resistor of claim 1, wherein the percentage of gold in said alloy varies between 10% and 50% by weight.

4. The thin film resistor of claim 1, wherein said layer of resistive metal is less than 5,000 angstroms thick.

5. The thin film resistor of claim 4, wherein said film is approximately 200 angstroms thick.

6. The thin film resistor of claim 1, comprising a thin layer of nickel covering said thin layer of resistive metal.

7. The thin film resistor of claim 6, comprising a thin layer of gold covering said layer of nickel.

8. The thin film resistor of claim 7, wherein the weight ratio of chrome to nickel is 3 to 2.

9. The thin film resistor of claim 1, wherein said predetermined percentages are selected to obtain a TCR of zero parts per million per degree centigrade.

10. The thin film resistor of claim 9, wherein said weight ratio of chrome to nickel in said alloy is 3 to 2 and the weight percentage of gold of said alloy is approximately 35%.

11. The thin film resistor of claim 10, wherein said layer of resistive metal is less than 5,000 angstroms thick.

12. The thin film resistor of claim 11, comprising a thin layer of nickel covering said thin layer of resistive metal.

13. The thin film resistor of claim 12, comprising a thin layer of gold covering said layer of nickel.

14. The thin film resistor of claim 4, wherein the weight ratio of chrome to nickel is 3 to 2.

15. The thin film resistor of claim 14, wherein the weight percentage of gold in said alloy varies between 10% to 50% by weight.

* * * * *